US009897961B2

(12) United States Patent
Watanabe

(10) Patent No.: US 9,897,961 B2
(45) Date of Patent: Feb. 20, 2018

(54) IMAGE FORMING APPARATUS PROVIDED WITH TRANSMISSION MECHANISM CAPABLE OF INTERRUPTING TRANSMISSION OF ROTATIONAL FORCE TO RECONVEYING ROLLER

(71) Applicant: Brother Kogyo Kabushiki Kaisha, Nagoya-shi, Aichi-ken (JP)

(72) Inventor: Tomonori Watanabe, Ichinomaya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/076,001

(22) Filed: Mar. 21, 2016

(65) Prior Publication Data

US 2016/0334746 A1 Nov. 17, 2016

(30) Foreign Application Priority Data

May 11, 2015 (JP) ..... 2015-096729

(51) Int. Cl.
*G03G 15/00* (2006.01)
*B65H 5/06* (2006.01)
*B65H 85/00* (2006.01)

(52) U.S. Cl.
CPC ..... *G03G 15/6529* (2013.01); *B65H 5/06* (2013.01); *B65H 85/00* (2013.01);
(Continued)

(58) Field of Classification Search
CPC ..... G03G 15/6529
(Continued)

(56) References Cited

U.S. PATENT DOCUMENTS 5,937,262 A * 8/1999 Cho ..... G03G 15/231 399/381
6,142,467 A * 11/2000 Funada ..... B65H 3/0669 271/10.04

(Continued)

FOREIGN PATENT DOCUMENTS

JP H05-330160 A 12/1993
JP 4438872 B2 3/2010

(Continued)

*Primary Examiner* — Anthony Nguyen
(74) *Attorney, Agent, or Firm* — Banner & Witcoff, Ltd.

(57) ABSTRACT

An image forming apparatus includes: an image-forming mechanism; a reconveying roller; an electric motor; and a transmission mechanism. The transmission mechanism is configured to operate in one of a reverse-rotation transmission mode for reversing a direction of a rotational force received from the electric motor to transmit the reversed rotational force to the reconveying roller and a normal-rotation transmission mode for transmitting the rotational force to the reconveying roller without reversing the direction of the rotational force. The transmission mechanism includes an interrupting unit for interrupting transmission of a rotational force from the reconveying roller to the electric motor at least when a sheet is being conveyed in the image-forming mechanism. The transmission mechanism is configured to interrupt transmission of the rotational force received from the electric motor to the reconveying roller when a sheet is being conveyed in the image-forming mechanism.

9 Claims, 10 Drawing Sheets

(52) U.S. Cl.
CPC ..... *B65H 2301/33312* (2013.01); *B65H 2403/92* (2013.01); *B65H 2801/06* (2013.01)

(58) Field of Classification Search
USPC ..... 399/401
See application file for complete search history.

(56) References Cited

U.S. PATENT DOCUMENTS

| | | | | |
|---|---|---|---|---|
| 7,931,265 | B2 | 4/2011 | Okamoto | |
| 8,036,567 | B2 | 10/2011 | Hayakawa | |
| 8,224,229 | B2 | 7/2012 | Okamoto | |
| 8,244,158 | B2 | 8/2012 | Miwa | |
| 8,556,256 | B2 * | 10/2013 | Ito | B65H 85/00 271/186 |
| 8,870,182 | B2 * | 10/2014 | Ogata | B41J 3/60 271/225 |
| 2008/0279601 | A1 * | 11/2008 | Sahara | B65H 29/12 399/401 |
| 2009/0200729 | A1 | 8/2009 | Okamoto | |
| 2009/0208242 | A1 | 8/2009 | Layakawa | |
| 2009/0277744 | A1 * | 11/2009 | Shinagawa | F16D 11/14 192/41 S |
| 2010/0104311 | A1 | 4/2010 | Okamoto | |
| 2010/0303502 | A1 | 12/2010 | Miwa | |
| 2012/0235350 | A1 * | 9/2012 | Watanabe | G03G 15/6529 271/228 |
| 2014/0294476 | A1 * | 10/2014 | Hashimoto | G03G 15/234 399/361 |
| 2015/0090536 | A1 * | 4/2015 | Chen | B66B 1/461 187/389 |
| 2015/0108715 | A1 * | 4/2015 | Yamada | B65H 85/00 271/272 |

FOREIGN PATENT DOCUMENTS

| | | | |
|---|---|---|---|
| JP | 4582234 | B2 | 11/2010 |
| JP | 2010-275075 | A | 12/2010 |
| JP | 4683058 | B2 | 5/2011 |
| JP | 2015-016931 | A | 1/2015 |

* cited by examiner

IMAGE FORMING APPARATUS PROVIDED WITH TRANSMISSION MECHANISM CAPABLE OF INTERRUPTING TRANSMISSION OF ROTATIONAL FORCE TO RECONVEYING ROLLER

CROSS REFERENCE TO RELATED APPLICATION

This application claims priority from Japanese Patent Application No. 2015-096729 filed May 11, 2015. The entire content of the priority application is incorporated herein by reference.

TECHNICAL FIELD

The present disclosure relates to an image forming apparatus capable of forming images on both sides of sheets (hereinafter referred to as "duplex printing").

BACKGROUND

There is conventionally known an image forming apparatus that is provided with a pendulum gear mechanism. The pendulum gear mechanism switches the transmission path for a rotational force generated by an electric motor to a path for transmitting the force to reconveying rollers. In this way, the image forming apparatus can transmit a unidirectional rotational force to the reconveying rollers, regardless of the direction in which the electric motor rotates.

Here, the reconveying rollers are conveying rollers used in a duplex printing operation for conveying a sheet having an image formed on one surface back to an image-forming mechanism to have an image formed on the other surface. The pendulum gear mechanism is a gear mechanism that can switch the state of a planetary gear or other pendulum gear between a state engaged directly with an output gear for transmitting the rotational force to the output gear, and a state engaged with an intermediate gear (idle gear) for transmitting the rotational force to the output gear through the intermediate gear.

SUMMARY

However, in the above-described conventional image forming apparatus, the rotational force is transmitted to the reconveying rollers even when performing simplex (single-sided) printing to form an image on only one side of the sheet. Thus, in the conventional image forming apparatus described above, the reconveying rollers rotate even when such rotation is unnecessary.

This unnecessary rotation of the reconveying rollers not only generates noise, but also leads to premature wear in the reconveying rollers and bearings and the like associated with the reconveying rollers.

In view of the foregoing, it is an object of the disclosure to provide an image forming apparatus capable of reducing noise generated by rotation of reconveying rollers.

In order to attain the above and other objects, according to one aspect, the disclosure provides an image forming apparatus configured to form images on both sides of a sheet, the image forming apparatus comprising: an image-forming mechanism; a discharge tray; a switchback roller; a reconveying roller; an electric motor; and a transmission mechanism. The image-forming mechanism is configured to form an image on a sheet while conveying the sheet. The discharge tray is configured to receive a sheet on which an image is formed. The switchback roller is configured to rotate in one of a normal rotation mode and a reverse rotation mode. The switchback roller in the normal rotation mode conveys a sheet discharged from the image-forming mechanism toward the discharge tray. The switchback roller in the reverse rotation mode conveys the sheet conveyed toward the discharge tray back toward the image-forming mechanism. The reconveying roller is configured to rotate while contacting a sheet to be conveyed back toward the image-forming mechanism to reconvey the sheet toward the image-forming mechanism. The electric motor is configured to supply the image-forming mechanism, the switchback roller, and the reconveying roller with a rotational force for conveying a sheet. The transmission mechanism is configured to operate in one of a reverse-rotation transmission mode and a normal-rotation transmission mode. The transmission mechanism in the reverse-rotation transmission mode reverses a direction of the rotational force received from the electric motor to transmit the reversed rotational force to the reconveying roller. The transmission mechanism in the normal-rotation transmission mode transmits the rotational force received from the electric motor to the reconveying roller without reversing the direction of the rotational force received from the electric motor. The transmission mechanism includes an interrupting unit configured to interrupt transmission of a rotational force from the reconveying roller to the electric motor at least when a sheet is being conveyed in the image-forming mechanism. The transmission mechanism is configured to interrupt transmission of the rotational force received from the electric motor to the reconveying roller when a sheet is being conveyed in the image-forming mechanism.

According to another aspect, the disclosure provides a transmission mechanism including: a sun gear; an output gear; a first intermediate gear; a second intermediate gear; and a locking mechanism. The sun gear is configured to receive a rotational force and configured to rotate about a rotational axis in a first rotational direction and in a second rotational direction opposite to the first rotational direction. The output gear is configured to output a rotational force. The first intermediate gear meshes with the output gear. The second intermediate gear, being a sector gear, includes: a toothed part in which teeth are formed; a toothless part in which no teeth are formed; and an engagement part. The interrupting unit is configured to be coupled to the first intermediate gear and the second intermediate gear. The interrupting unit is configured to transmit a rotational force from the second intermediate gear to the first intermediate gear and configured to interrupt a rotational force from the first intermediate gear to the second intermediate gear. The locking mechanism includes: a revolving member; a first planetary gear; a second planetary gear; and a spring. The revolving member has an engaging part engageable with the engagement part of the second intermediate gear. The revolving member is configured to move between an engaging position where the engaging part is engageable with the engagement part of the second intermediate gear and a release position where the engaging part is separated from the engagement part of the second intermediate gear. The revolving member moves to the engaging position in response to the rotation of the sun gear in the first rotational direction and moves to the release position in response to the rotation of the sun gear in the second rotational direction. The first planetary gear meshes with the sun gear and is supported at the revolving member. The first planetary gear is configured to revolve about the rotational axis of the sun gear along with the revolving member. The first planetary gear is configured to mesh with the output gear in response to the rotation of the sun gear in the second rotational direction. The second planetary gear meshes with the sun gear and is supported at the revolving member. The second planetary gear is configured to revolve about the rotational axis of the sun gear along with the revolving member. The second planetary gear is configured to move to a position capable of meshing with the toothed part of the second intermediate gear in response to the rotation of the sun gear in the first rotational direction. The spring is configured to apply a force to the second intermediate gear to rotate the second intermediate gear in the first rotational direction. While the sun gear rotates in the first rotational direction and the second planetary gear faces the toothless part of the second intermediate gear, the revolving member is in the engaging position, and a rotational force of the sun gear rotating in the first rotational direction is transmitted to the second planetary gear facing the toothless part of the second intermediate gear. When the sun gear changes the rotational direction from the first rotational direction to the second rotational direction, the first planetary gear and the second planetary gear revolve in the second rotational direction about the rotational axis of the sun gear to move the revolving member from the engaging position to the release position, and the spring rotates the second intermediate gear to a position where the toothed part of the second intermediate gear is capable of meshing with the second planetary gear when the revolving member is returned from the release position to the engaging position. While the revolving member is in the release position, the first planetary gear meshes with the output gear, and a rotational force of the sun gear rotating in the second rotational direction is transmitted to the output gear through the first planetary gear. When the sun gear changes the rotational direction from the second rotational direction to the first rotational direction, the first planetary gear and the second planetary gear revolve in the first rotational direction about the rotational axis of the sun gear to move the revolving member from the release position to the engaging position, and the second planetary gear meshes with the toothed part of the second intermediate gear to rotate the second intermediate gear until the toothless part of the second intermediate gear faces the second planetary gear, and a rotational force of the sun gear rotating in the first rotational direction is transmitted to the output gear through the second planetary gear, the toothed part of the second intermediate gear, the interrupting unit, and the first intermediate gear while the second planetary gear meshes with the toothed part of the second intermediate gear. When the toothless part of the second intermediate gear has returned to a position facing the second planetary gear as a result of the rotation of the second intermediate gear through meshing with the secondary planetary gear while the sun gear rotates in the first rotational direction, transmission of the rotational force of the sun gear rotating in the first rotational direction to the output gear is interrupted.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Embodiment

Figure 1:
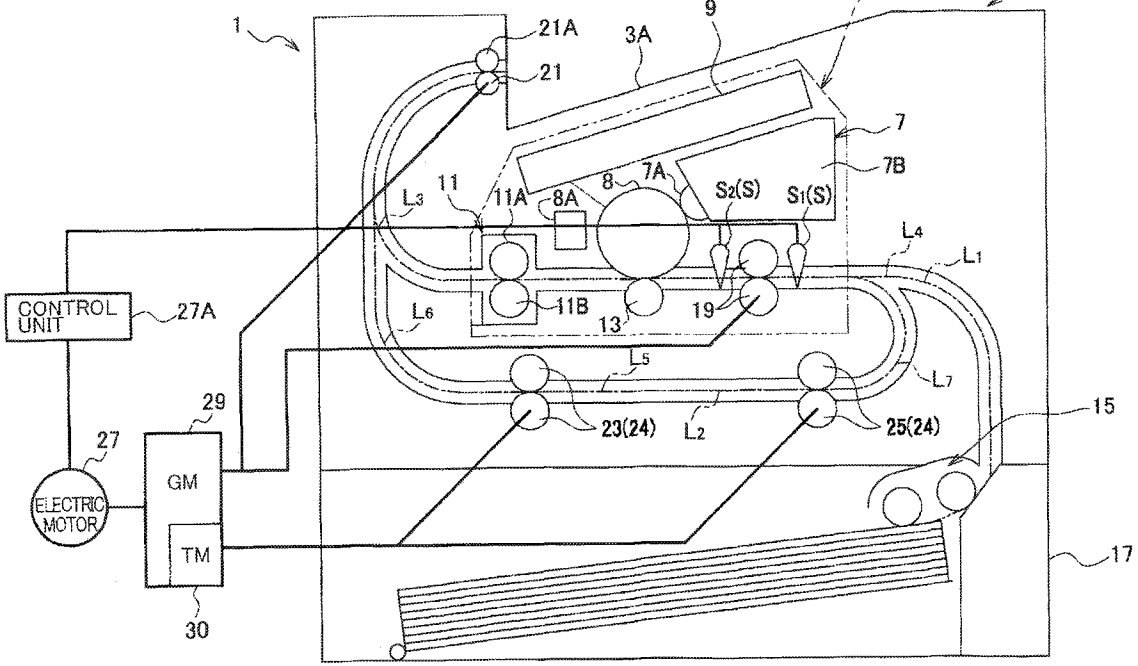
FIG. 1 is a schematic central cross-sectional view of an image forming apparatus 1 according to one embodiment.

An image forming apparatus 1 according to one embodiment will be described with reference to the accompanying drawings, wherein like parts and components are designated by the same reference numerals to avoid duplicating description.

1. Structure of Image Forming Apparatus 1.1 Overall Structure

FIG. 1 shows a monochromatic, electrophotographic image forming apparatus 1. The image forming apparatus 1 includes a casing 3, and an image-forming mechanism 5 accommodated in the casing 3.

In the following description, arrows indicating directions and the like in the drawings are intended to facilitate understanding of how the drawings relate to each other, but the disclosure is not limited to the specified directions.

Further, the image forming apparatus 1 according to the embodiment is provided with at least one of each part and component designated with a symbol or reference numeral, except when the numbers of the parts and components are specifically stated as being a "plurality," "two or more," or the like.

The image-forming mechanism 5 is adapted to form images on sheets of paper or another recording medium. The image-forming mechanism 5 includes a developing cartridge 7, a photosensitive drum 8, an exposure unit 9, a fixing unit 11, and a pair of registration rollers 19.

The developing cartridge 7 includes a developing roller 7A, and a storage section 7B. The photosensitive drum 8 is adapted to carry developer images on its circumferential surface. After a charger 8A applies a charge to the circumferential surface of the photosensitive drum 8, the exposure unit 9 exposes the charged photosensitive drum 8, forming an electrostatic latent image on the circumferential surface of the photosensitive drum 8.

The developing roller 7A is adapted to supply developer accommodated in the storage section 7B to the photosensitive drum 8, forming a developer image on the photosensitive drum 8. A transfer roller 13 is disposed at a position confronting the photosensitive drum 8.

The transfer roller 13 is adapted to transfer the developer image carried on the photosensitive drum 8 to a sheet passing between the photosensitive drum 8 and the transfer roller 13.

The fixing unit 11 is adapted to fix the transferred developer to the sheet. Specifically, the fixing unit 11 includes a heating roller 11A, and a pressure roller 11B.

The heating roller 11A is adapted to directly or indirectly heat the developer image on the sheet, while the pressure roller 11B presses the sheet against the heating roller 11A. Subsequently, the fixing unit 11 conveys the sheet toward a discharge tray 3A formed on a top surface of the casing 3. Thus, sheets are received in the discharge tray 3A after images have been formed thereon.

The image forming apparatus 1 also includes a feeding mechanism 15 disposed upstream of the image-forming mechanism 5 in a sheet-conveying direction. The feeding mechanism 15 is adapted to feed sheets one at a time from a paper tray 17 toward the image-forming mechanism 5.

The paper tray 17 is removably mounted in the casing 3. A user can remove the paper tray 17 from the casing 3 in order to load sheets into the paper tray 17 or change the types of sheets loaded therein.

The sheets placed on the paper tray 17 are conveyed along a conveying path L1 leading from the paper tray 17 to the discharge tray 3A via the image-forming mechanism 5. The pair of registration rollers 19 is provided on the conveying path L1 at a position upstream of the photosensitive drum 8 in the sheet-conveying direction.

The pair of registration rollers 19 is adapted to correct the orientation of sheets to be fed into the image-forming mechanism 5. More specifically, rotation of the registration rollers 19 is halted when a leading edge of a sheet relative to the sheet-conveying direction arrives at the registration rollers 19 or just prior to the leading edge arriving at the registration rollers 19.

Consequently, the leading edge of the sheet contacts outer circumferential surfaces of the non-rotating registration rollers 19, causing the sheet's orientation to be corrected until the leading edge of the sheet is aligned with the outer circumferential surfaces of the registration rollers 19. Subsequently, the registration rollers 19 resume rotating, drawing the sheet into the image-forming mechanism 5 (to the photosensitive drum 8).

The image forming apparatus 1 is further provided with a pre-registration sensor S1 positioned upstream of the registration rollers 19 in the sheet-conveying direction, and a post-registration sensor S2 positioned downstream of the registration rollers 19 in the sheet-conveying direction. The pre-registration sensor S1 and the post-registration sensor S2 (hereinafter also collectively referred to as registration sensors S) are adapted to output signals indicating whether a sheet is present at their respective positions.

That is, the signals outputted by the registration sensors S correspond to whether a sheet is present or not. Specifically, the registration sensors S output a Lo level signal when a sheet has been detected, and a Hi level signal when a sheet has not been detected, for example.

In other words, the registration sensors S output a Lo level signal when the leading edge of a sheet relative to the sheet-conveying direction arrives at their positions, and output a Hi level signal when the trailing edge of the sheet relative to the conveying direction arrives at their positions.

Start and stop of rotation of the registration rollers 19 are controlled by selectively supplying an interrupting current to an electromagnetic clutch (not shown). Specifically, rotation of the registration rollers 19 is halted when a prescribed time has elapsed after the post-registration sensor S2 detects the trailing edge of a sheet. Rotation of the registration rollers 19 is resumed when a prescribed time has elapsed after the pre-registration sensor S1 detects the leading edge of a sheet.

A discharge roller 21 is provided at a position downstream of the fixing unit 11 in the sheet-conveying direction. The discharge roller 21 functions to discharge sheets into the discharge tray 3A. In addition to this function, the discharge roller 21 also has a reconveying function for reversing the conveyed direction of a sheet exiting the fixing unit 11 and reconveying the sheet back to the photosensitive drum 8.

That is, the image forming apparatus 1 according to the embodiment can selectively execute one of two printing modes: a simplex printing mode for forming an image on only one side of a sheet; and a duplex printing mode for forming images on both sides of a sheet. Hereinafter, the discharge roller 21 will also be referred to as a "switchback roller 21." A pinch roller 21A is disposed in confrontation with the switchback roller 21 for pressing a sheet against the switchback roller 21 while following the rotation of the switchback roller 21.

In the following description, a mode in which the switchback roller 21 rotates for conveying a sheet toward the discharge tray 3A will be referred to as a normal rotation mode, while a mode in which the switchback roller 21 rotates for conveying a sheet back toward the image-forming mechanism 5 will be referred to as a reverse rotation mode.

When the image forming apparatus 1 is operating in the duplex printing mode, the switchback roller 21 reverses the conveyed direction of a sheet after an image has been formed on one side thereof and reconveys the sheet along a reconveying path L2. The reconveying path L2 is a sheet-conveying path leading from the switchback roller 21 toward the photosensitive drum 8.

1.2 Structure of Reconveying Path

The reconveying path L2 branches from the conveying path L1 in an area downstream in the sheet-conveying direction of the fixing unit 11 that will be referred to as a branch point L3, and rejoins the conveying path L1 in an area upstream in the sheet-conveying direction of the pre-registration sensor S1 that will be referred to as a rejoining point L4. The reconveying path L2 includes a conveying path L5 between the branch point L3 and the rejoining point L4. The conveying path L5 is offset below the image-forming mechanism 5 including the photosensitive drum 8.

Curved conveying paths L6 and L7 are respectively provided on upstream and downstream of the conveying path L5 for connecting the conveying path L5 to the conveying path L1. The curved conveying paths L6 and L7 function to change the direction of the conveyed sheet after the sheet have been discharged from the fixing unit 11.

A pair of first reconveying rollers 23 and a pair of second reconveying rollers 25 are provided on the conveying path L5. The pair of first reconveying rollers 23 is disposed on the exit side of the curved conveying path L6 and convey sheets downstream of the conveying path L5.

The pair of second reconveying rollers 25 is disposed on the entrance side of the curved conveying path L7 and reconveys the sheets toward the pair of registration rollers 19. The pair of registration rollers 19 is disposed on the exit side of the curved conveying path L7. In the following description, the pair of first reconveying rollers 23 and the pair of second reconveying rollers 25 will be collectively referred to as reconveying rollers 24.

2. Rotation Control of Switchback Roller and Reconveying Rollers 2.1 Overview of Rotation Control As shown in FIG. 1, the image forming apparatus 1 is provided with a single electric motor 27 (an example of an electric motor) that is adapted to supply a rotational force to the image-forming mechanism 5, the switchback roller 21, and the reconveying rollers 24. The image forming apparatus 1 is also provided with a gear mechanism 29 having a plurality of gears and the like for transmitting the rotational force generated by the electric motor 27 to the switchback roller 21 and the like.

A control unit 27A is provided in the image forming apparatus 1 for controlling the rotation of the electric motor 27, and specifically for controlling when the electric motor 27 rotates in the normal direction and the reverse direction and when the electric motor 27 is halted. The control unit 27A controls the rotation of the electric motor 27 according to a pre-stored program (software) and based on signals from the pre-registration sensor S1.

The control unit 27A is configured of a microcomputer having a CPU, ROM, RAM, and the like. The program used for implementing control is stored in the ROM or another nonvolatile storage unit.

The rotating directions of the switchback roller 21, the pair of registration rollers 19, the photosensitive drum 8, the heating roller 11A, and the like are linked to the rotating direction of the electric motor 27. Specifically, when the electric motor 27 rotates in the normal direction, the switchback roller 21, the pair of registration rollers 19, the photosensitive drum 8, the heating roller 11A, and the like rotate in directions for conveying sheets toward the discharge tray 3A (hereinafter referred to as normal rotation).

When the electric motor 27 rotates in the reverse direction, the switchback roller 21, the pair of registration rollers 19, the photosensitive drum 8, the heating roller 11A, and the like rotate in the directions opposite their normal rotations (hereinafter referred to as reverse rotation).

The gear mechanism 29 includes a transmission mechanism 30 that transmits the rotational force of the electric motor 27 to the reconveying rollers 24. Accordingly, the rotating direction of the reconveying rollers 24 does not always match the rotating direction of the electric motor 27, depending on transmission modes of the transmission mechanism 30.

More specifically, the transmission mechanism 30 can operate in one of a reverse-rotation transmission mode and a normal-rotation transmission mode. In the reverse-rotation transmission mode, the transmission mechanism 30 reverses the direction of the rotational force received from the electric motor 27 and transmits this reversed force to the reconveying rollers 24. In the normal-rotation transmission mode, the transmission mechanism 30 transmits the rotational force received from the electric motor 27 to the reconveying rollers 24 without reversing the direction of the rotational force.

The transmission mechanism 30 also has a first interrupting function and a second interrupting function. The first interrupting function serves to interrupt transmission of a rotational force from the reconveying rollers 24 to the electric motor 27 at least while a sheet is being conveyed in the image-forming mechanism 5. The second interrupting function serves to interrupt transmission of a rotational force to the reconveying rollers 24 while a sheet is being conveyed in the image-forming mechanism 5.

2.2 Configuration of Transmission Mechanism

<First Interrupting Function>

Figure 2B:
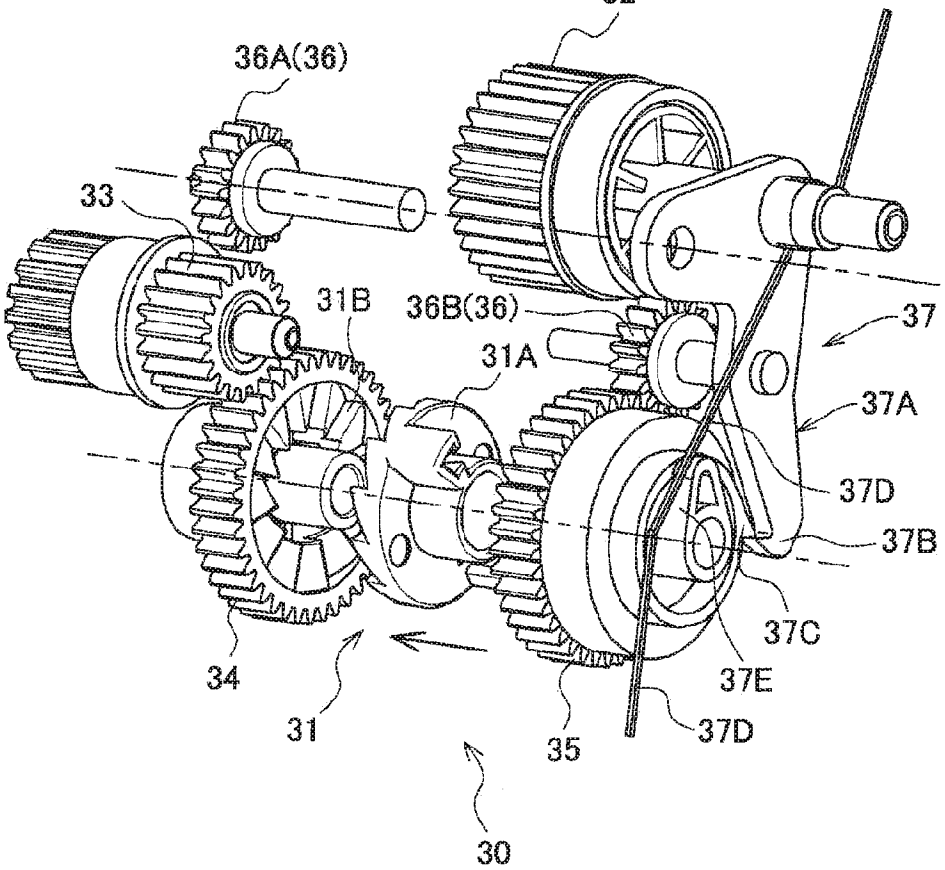
FIG. 2B is an exploded perspective view of the transmission mechanism 30.

The first interrupting function is implemented using an interrupting unit 31 shown in FIG. 2B. The interrupting unit 31 includes a ratchet gear 31A, a pawl gear 31B, and a spring (not shown) that presses the ratchet gear 31A toward the pawl gear 31B.

The ratchet gear 31A is displaceable in a direction of its rotational axis. The pawl gear 31B is capable of engaging with the ratchet gear 31A. When a rotational force is inputted into the ratchet gear 31A, the ratchet gear 31A and the pawl gear 31B are maintained in an engaged state. Hence, the rotational force is transmitted from the ratchet gear 31A to the pawl gear 31B.

When a rotational force is inputted into the pawl gear 31B, a force in the axial direction is generated by engaged parts of the ratchet gear 31A and the pawl gear 31B, forcing the ratchet gear 31A and the pawl gear 31B to separate. Accordingly, transmission of the rotational force from the pawl gear 31B to the ratchet gear 31A is interrupted.

Figure 9:
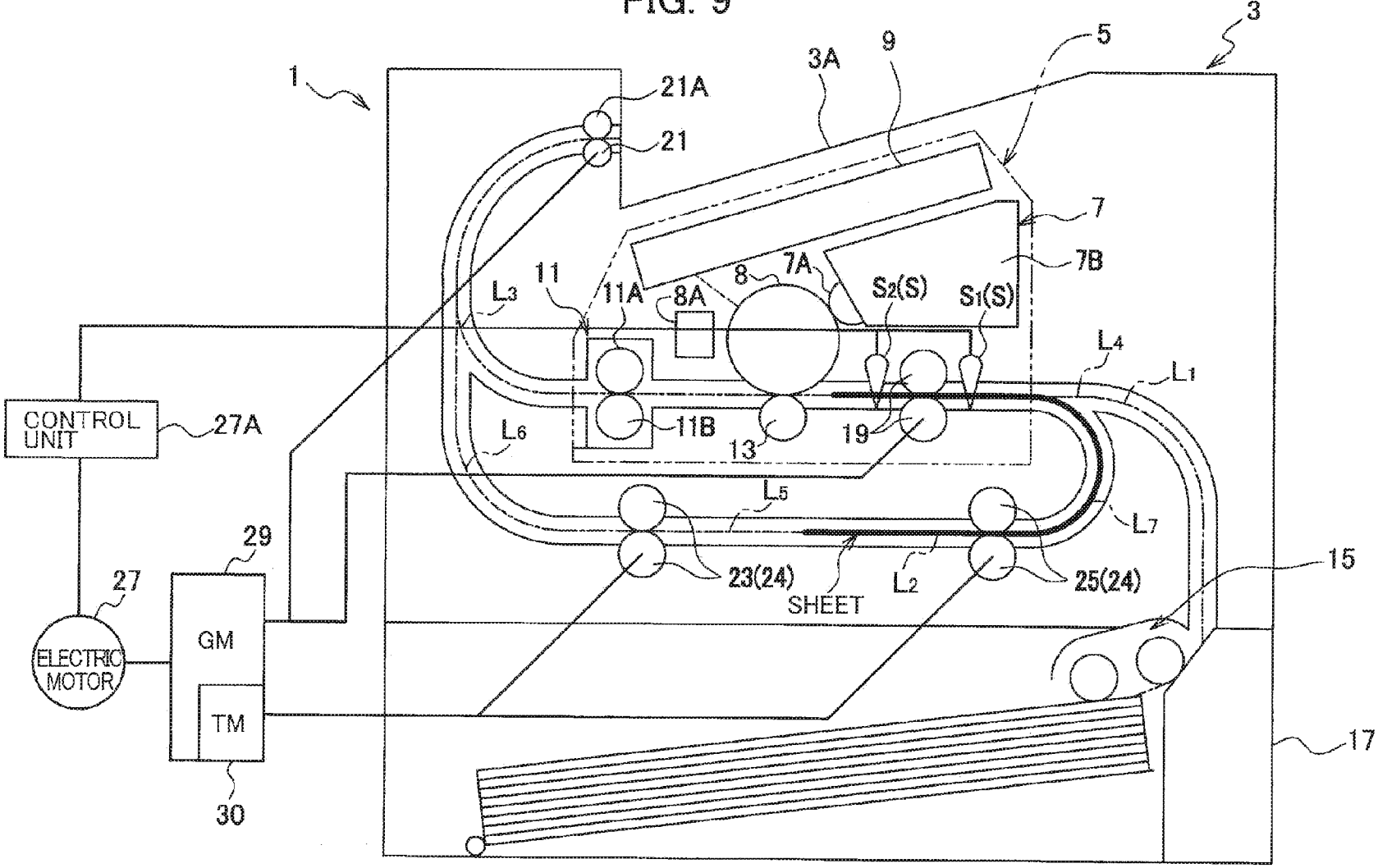
FIG. 9 is a schematic central cross-sectional view of the image forming apparatus 1, illustrating a sheet conveying state following the state shown in FIG. 8.

The interrupting unit 31 is placed in its interrupting state for interrupting transmission of a rotational force when at least the pair of registration rollers 19 and the reconveying rollers 24 are simultaneously contacting the same sheet, as illustrated in FIG. 9.

In this state, the sheet receives a conveying force from the pair of registration rollers 19, while the reconveying rollers 24 rotate to follow the conveyance of the sheet. Therefore, the reconveying rollers 24 do not hinder conveyance of a sheet when the sheet is being conveyed by the pair of registration rollers 19.

<Second Interrupting Function>

Figure 2A:
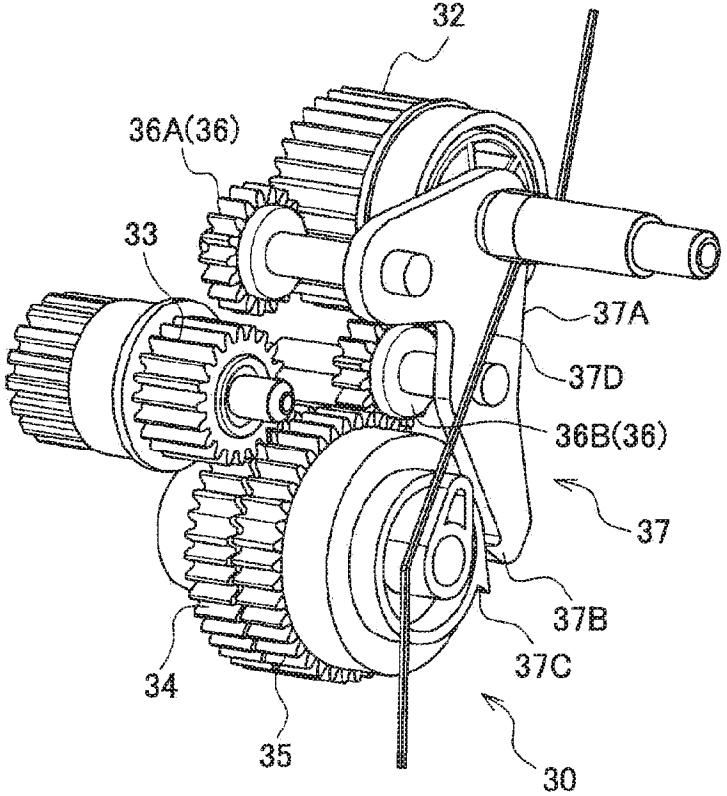
FIG. 2A is a perspective view of a transmission mechanism 30 provided in the image forming apparatus 1 according to the embodiment.

As shown in FIG. 2A, the second interrupting function is implemented by a gear mechanism that uses a planetary gear mechanism.

That is, the mechanical components of the transmission mechanism 30 that implement the second interrupting function include a sun gear 32, an output gear 33, an output-side intermediate gear 34 (an example of a first intermediate gear), an input-side intermediate gear 35 (an example of a second intermediate gear), a first planetary gear 36A, a second planetary gear 36B, and a locking mechanism 37. In the following description, the first planetary gear 36A and the second planetary gear 36B will also be collectively referred to as planetary gears 36.

<Sun Gear and Output Gear>

The sun gear 32 rotates when a rotational force supplied from the electric motor 27 is inputted into the sun gear 32. A rotational center of the sun gear 32 is fixed relative to a reconveying unit (not shown) constituting the reconveying path L2. The output gear 33 outputs a rotational force to the reconveying rollers 24.

After the output gear 33 outputs a rotational force to the pair of second reconveying rollers 25, a portion of the rotational force is diverted to the pair of first reconveying rollers 23. The reconveying unit is provided with a diverting mechanism (not shown) for diverting the rotational force outputted from the output gear 33 to the pair of first reconveying rollers 23 and the pair of second reconveying rollers 25.

<Output-Side Intermediate Gear and Input-Side Intermediate Gear>

The output-side intermediate gear 34 is meshingly engaged with the output gear 33 at all times. Hence, the output gear 33 rotates when a rotational force is inputted into the output-side intermediate gear 34. Conversely, the output-side intermediate gear 34 rotates when a rotational force is inputted into the output gear 33.

The input-side intermediate gear 35 is coupled to the output-side intermediate gear 34 via the interrupting unit 31. Hence, a rotational force can be transmitted from the input-side intermediate gear 35 to the output-side intermediate gear 34, but cannot be transmitted from the output-side intermediate gear 34 to the input-side intermediate gear 35.

Figure 3A:
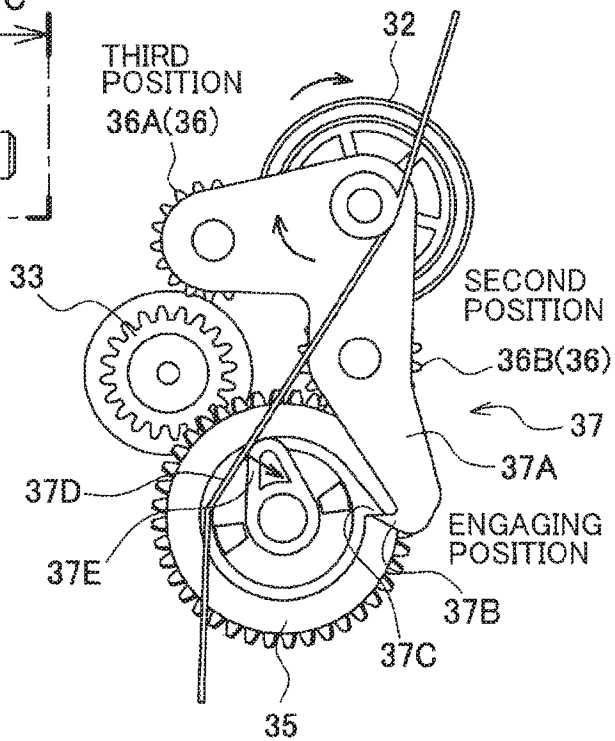
FIG. 3A is a front view of the transmission mechanism 30.
Figure 3B:
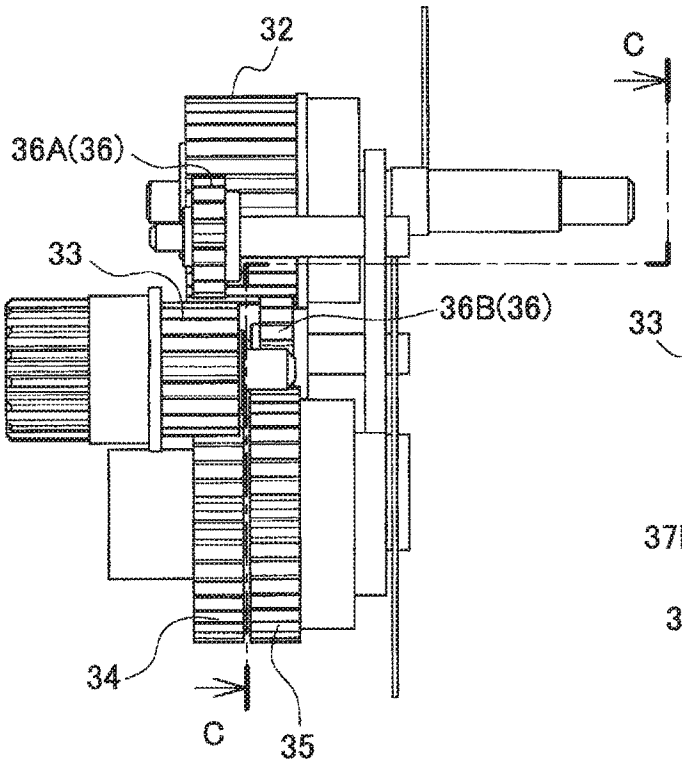
FIG. 3B is a left side view of the transmission mechanism 30.
Figure 3C:
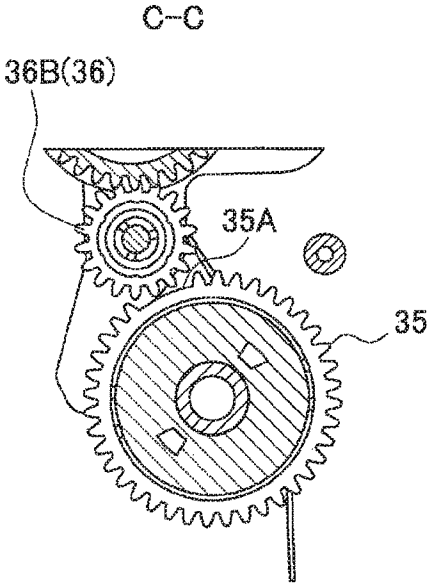
FIG. 3C is a cross-sectional view of the transmission mechanism 30 taken along a line C-C in FIG. 3B.
Figure 4A:
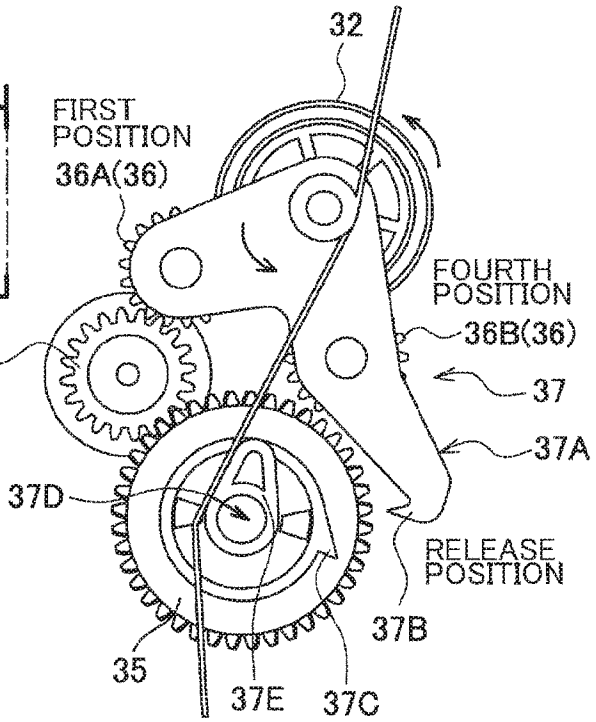
FIG. 4A is a front view of the transmission mechanism 30.
Figure 4B:
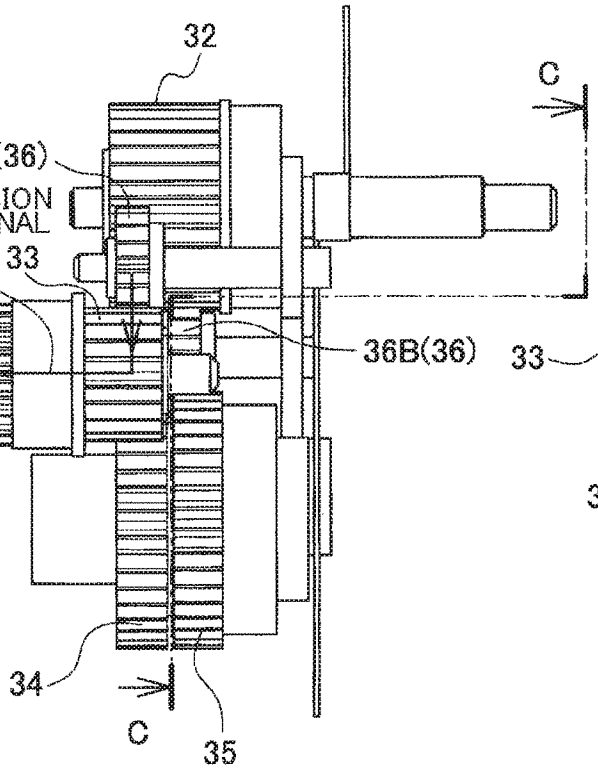
FIG. 4B is a left side view of the transmission mechanism 30.
Figure 4C:
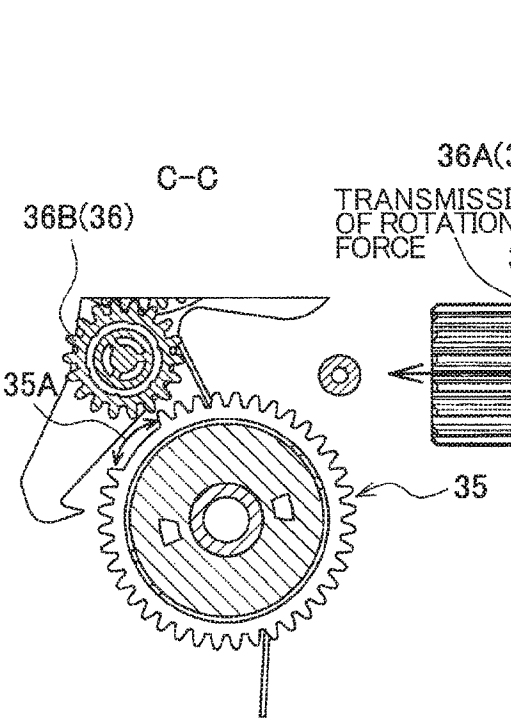
FIG. 4C is a cross-sectional view of the transmission mechanism 30 taken along a line C-C in FIG. 4B.
Figure 5A:
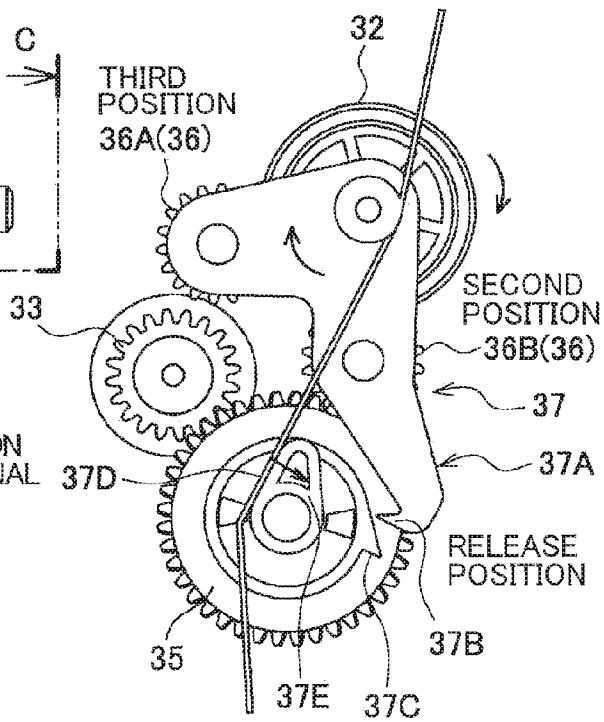
FIG. 5A is a front view of the transmission mechanism 30.
Figure 5B:
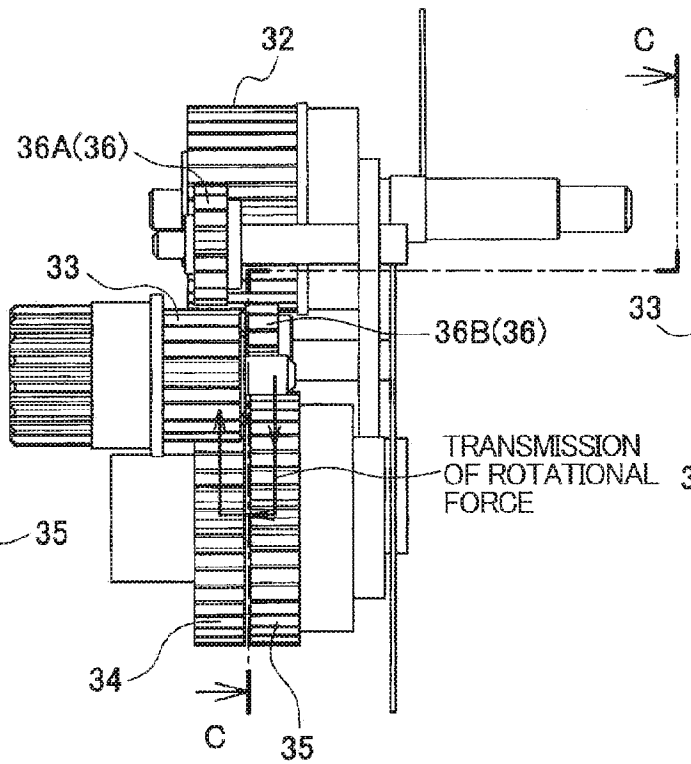
FIG. 5B is a left side view of the transmission mechanism 30.
Figure 5C:
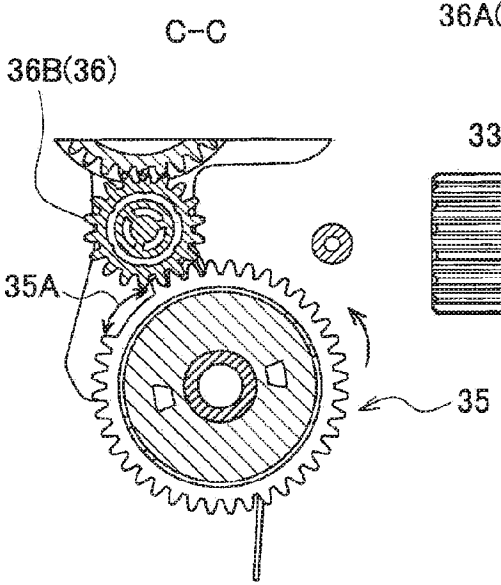
FIG. 5C is a cross-sectional view of the transmission mechanism 30 taken along a line C-C in FIG. 5B.
Figure 10:
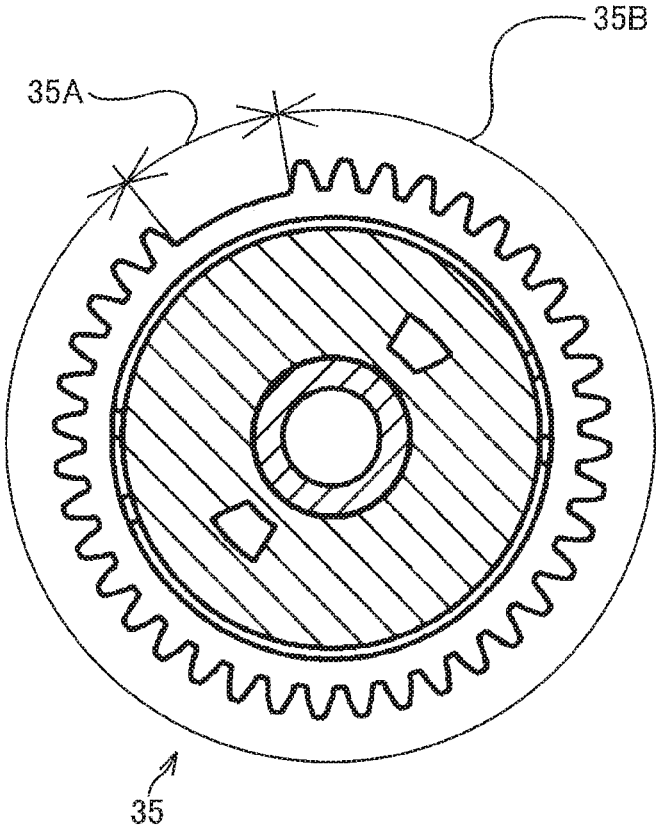
FIG. 10 is a view of an input-side intermediate gear 35 of the transmission mechanism 30 illustrating a toothless part 35A and a toothed part 35B thereof.

As shown in FIGS. 3C, 4C, and 5C, the input-side intermediate gear 35 includes a toothless part 35A constituting a part of its circumferential surface in which no teeth are provided, and a toothed part 35B constituting a remaining part of the circumferential surface in which teeth are provided (see also FIG. 10). That is, the input-side intermediate gear 35 is a sector gear (i.e. partially-toothless gear). Hence, when teeth of the second planetary gear 36B are positioned within the toothless part 35A (see FIG. 3C), transmission of a rotational force from the second planetary gear 36B to the input-side intermediate gear 35 is interrupted.

<Planetary Gears>

As shown in FIG. 2A, the planetary gears 36 are meshingly engaged with the sun gear 32 at all times and rotate upon rotation of the sun gear 32. A rotational force transmitted from the sun gear 32 to the planetary gears 36 acts as a revolving force for displacing the rotational centers of the planetary gears 36 by revolving the planetary gears 36 about the rotational center of the sun gear 32. Note that the term "revolve" is used here interchangeably with "orbitally move". Further, in the following description, the rotations of the planetary gears 36 about their own rotational centers will be referred to as "rotation."

That is, the planetary gears 36 are meshingly engaged with the sun gear 32 at all times. Therefore, when the sun gear 32 rotates, the planetary gears 36 receive the rotational force of the sun gear 32. At this time, if the rotational centers of the planetary gears 36 are in a nondisplaceable state, the rotational force supplied from the sun gear 32 serves as a rotating force for rotating the planetary gears 36.

However, if the rotational centers of the planetary gears 36 are in a displaceable state, the rotational force supplied from the sun gear 32 serves as a revolving force for revolving the planetary gears 36 about the rotational center of the sun gear 32. Consequently, the revolving direction of the planetary gears 36 matches the rotating direction of the sun gear 32.

When receiving a revolving force from the sun gear 32, the planetary gears 36 can be displaced by revolving between a first position in which the planetary gear 36A is meshingly engaged with the output gear 33 and a second position in which the planetary gear 36B is meshingly engageable with the input-side intermediate gear 35.

More specifically, the first planetary gear 36A can be displaced by revolving between the first position (the position shown in FIG. 4A) in which the first planetary gear 36A is meshingly engaged with the output gear 33 and a third position (the position shown in FIGS. 3A and 5A) offset from the first position and different from the second position.

The second planetary gear 36B can be displaced by revolving between the second position (the position shown in FIGS. 3A and 5A) in which the second planetary gear 36B is meshingly engageable with the input-side intermediate gear 35 and a fourth position (the position shown in FIG. 4A) offset from the second position and different from the first position.

The first planetary gear 36A and the second planetary gear 36B are revolvably and rotatably supported by a revolving member 37A (described later). Accordingly, the first planetary gear 36A and the second planetary gear 36B revolve as a unit.

Thus, the second planetary gear 36B is in the fourth position when the first planetary gear 36A is in the first position. The first planetary gear 36A is in the third position when the second planetary gear 36B is in the second position.

If the sun gear 32 is rotated counterclockwise in FIG. 3A while the first planetary gear 36A is in the third position (see FIG. 3A, for example), the first planetary gear 36A revolves counterclockwise together with the sun gear 32 to be displaced from the third position to the first position (see FIG. 4A).

When the first planetary gear 36A is meshingly engaged with the output gear 33, the rotational center of the first planetary gear 36A is in a nondisplaceable state. This arrangement halts the revolution of the first planetary gear 36A, and the rotational force supplied from the sun gear 32 acts as a rotating force for rotating the first planetary gear 36A. As a result, the rotational force of the sun gear 32 is transmitted to the output gear 33 via the first planetary gear 36A.

If the sun gear 32 is rotated clockwise in FIG. 4A while the second planetary gear 36B is in the fourth position (see FIG. 4A, for example), the second planetary gear 36B revolves clockwise together with the sun gear 32 to be displaced from the fourth position to the second position (see FIGS. 3A and 5A).

When the second planetary gear 36B is meshingly engaged with the input-side intermediate gear 35, the rotational center of the second planetary gear 36B is in a nondisplaceable state. This arrangement halts the revolution of the second planetary gear 36B, and the rotational force supplied from the sun gear 32 acts as a rotating force for rotating the second planetary gear 36B.

If the second planetary gear 36B is offset from the position of the toothless part 35A at this time (see FIG. 5C), the rotational force of the sun gear 32 is transmitted to the input-side intermediate gear 35 via the second planetary gear 36B. This rotational force transmitted to the input-side intermediate gear 35 is then relayed to the output gear 33 via the interrupting unit 31 and the output-side intermediate gear 34.

If the teeth of the second planetary gear 36B are positioned in the toothless part 35A while the second planetary gear 36B is in the second position (see FIG. 3C), the rotational force of the sun gear 32 is not transmitted to the output gear 33.

Note that the rotating direction of the output gear 33 when a rotational force is transmitted to the output gear 33 via the first planetary gear 36A is identical to the rotating direction of the output gear 33 when a rotational force is transmitted to the output gear 33 via the second planetary gear 36B.

<Locking Mechanism>

The locking mechanism 37 functions to halt rotation of the input-side intermediate gear 35 and to situate the second planetary gears 36B in the second position within the area of the toothless part 35A (see FIG. 3C) while a sheet is being conveyed in the image-forming mechanism 5. As shown in FIG. 2B, the locking mechanism 37 includes the revolving member 37A, and a spring 37D.

The revolving member 37A has an engaging part 37B that engages with an engagement part 37C provided on the input-side intermediate gear 35. The revolving member 37A can be displaced by revolving between an engaging position (see FIG. 3A) in which the engaging part 37B is engaged with the engagement part 37C, and a release position (see FIGS. 4A and 5A) in which the engaging part 37B is disengaged from the engagement part 37C.

The spring 37D exerts a resilient force on the input-side intermediate gear 35 for rotating the input-side intermediate gear 35 to a position meshingly engaged with the second planetary gear 36B in the second position. As shown in FIG. 3A, a cam 37E that is substantially triangular in shape is provided on a portion of the input-side intermediate gear 35 that slides in contact with (or "slidingly contacts") the spring 37D.

The spring 37D presses the cam 37E while slidingly contacting a portion of the cam 37E offset from the rotational center of the input-side intermediate gear 35. Through this arrangement, the spring 37D applies a rotational force to the input-side intermediate gear 35.

When the engaging part 37B and the engagement part 37C are in an engaged state, the input-side intermediate gear 35 cannot rotate even when the spring 37D applies its rotational force to the input-side intermediate gear 35. When the revolving member 37A is displaced by revolving from its engaging position to its release position, the input-side intermediate gear 35 is rotated by the rotational force applied from the spring 37D and becomes meshingly engaged with the second planetary gear 36B, as shown in FIG. 5C.

2.3 Operations of Electric Motor and Transmission Mechanism

Figure 6:
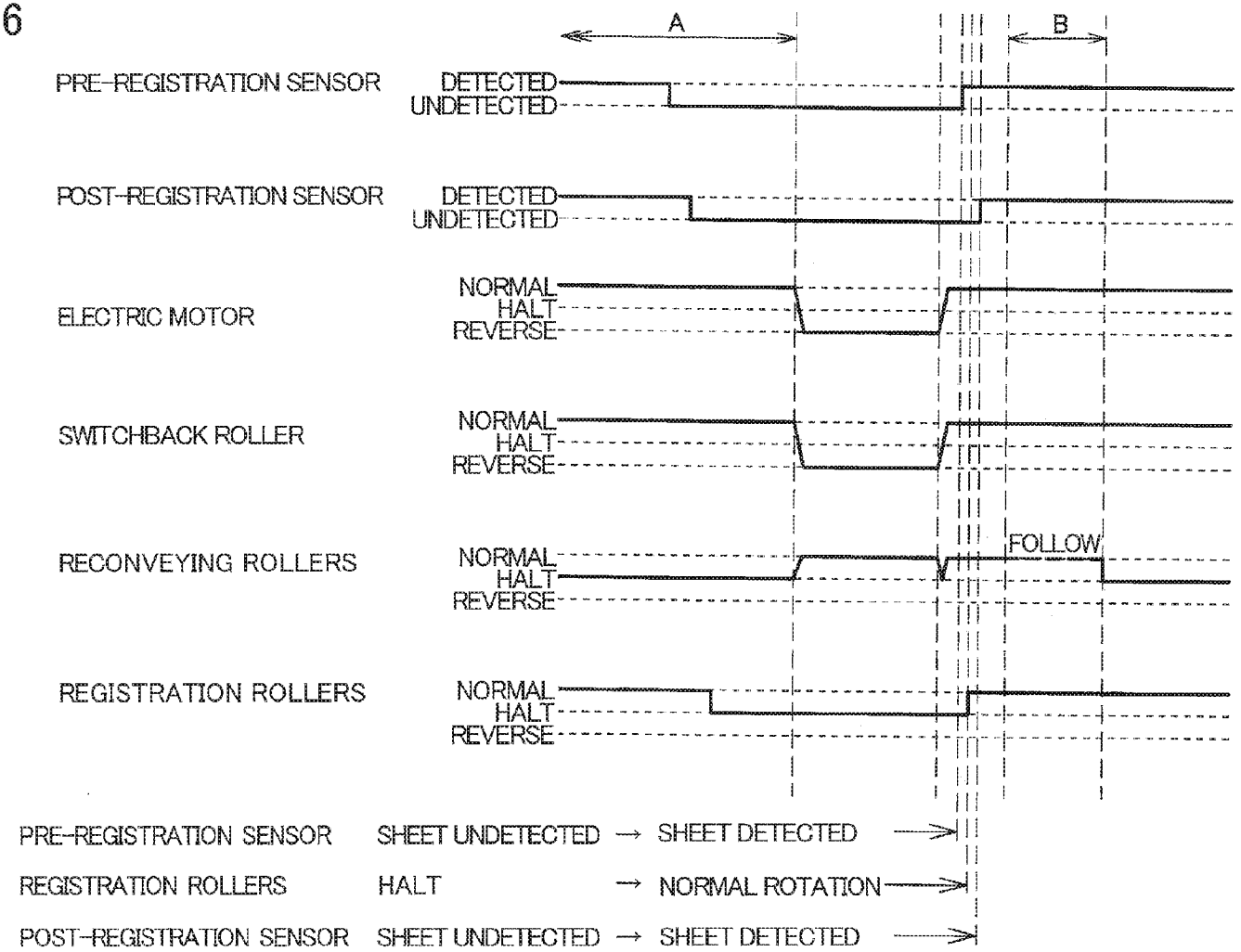
FIG. 6 is a timing chart of the image forming apparatus 1.
Figure 7:
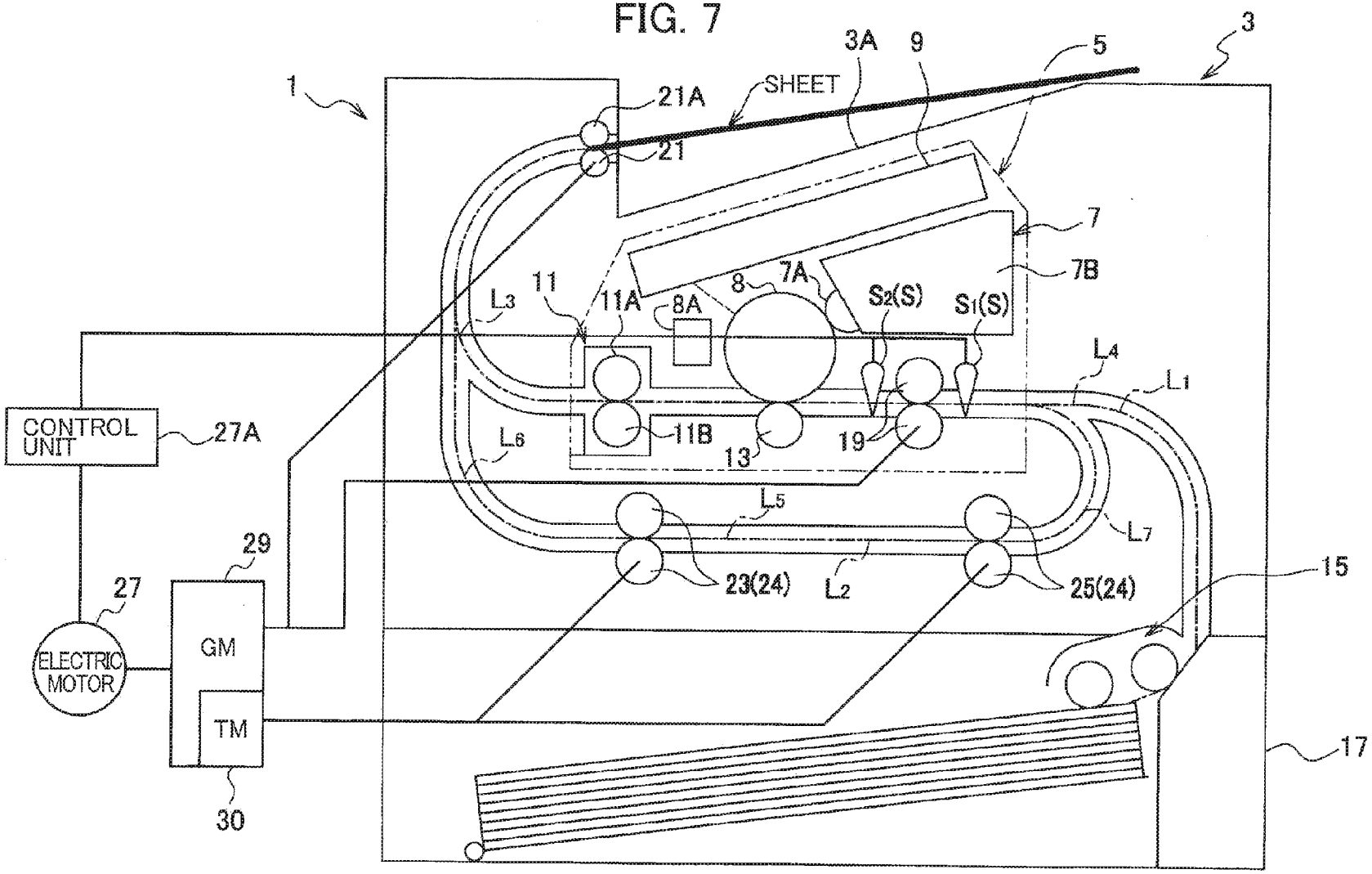
FIG. 7 is a schematic central cross-sectional view of the image forming apparatus 1, illustrating a sheet conveying state at a region A in FIG. 6.

When the image forming apparatus 1 performs an image-forming operation on a sheet in either the simplex printing mode or the duplex printing mode, the electric motor 27 is rotated in the normal direction (indicated by a region A in FIG. 6). At this time, the sun gear 32 rotates in the normal direction (clockwise in FIG. 3A, an example of a first rotational direction) and the revolving member 37A is in the engaging position.

Since the teeth of the second planetary gear 36B are positioned within the toothless part 35A while the second planetary gear 36B is in the second position (see FIG. 3C), the rotational force of the sun gear 32 is not transmitted to the output gear 33, and the reconveying rollers 24 remain halted.

After an image-forming operation has been completed for one side of a sheet in the duplex printing mode, and specifically once a prescribed time has elapsed after the post-registration sensor S2 has detected the trailing edge of the sheet relative to the sheet-conveying direction so that the trailing edge of the sheet has passed through the branch point L3, the electric motor 27 is shifted from normal rotation to reverse rotation.

Consequently, the switchback roller 21 shifts from the normal rotation mode to the reverse rotation mode, and the sun gear 32 begins rotating counterclockwise in FIG. 3A (an example of a second rotational direction). Since a counterclockwise revolving force is applied to the planetary gears 36 (first planetary gear 36A and second planetary gear 36B), the revolving member 37A is displaced by revolving from the engaging position to the release position, as illustrated in FIG. 4A.

Thus, the first planetary gear 36A is displaced from the third position to the first position, and the second planetary gear 36B is displaced from the second position to the fourth position. Therefore, since the rotational force of the sun gear 32 is transmitted to the output gear 33 via the first planetary gear 36A, the reconveying rollers 24 begin to rotate.

Since the revolving member 37A is in the release position, the input-side intermediate gear 35 receives the rotational force from the spring 37D and rotates a prescribed angle (see FIG. 4C). In this description, the prescribed angle denotes a rotational angle at which the second planetary gear 36B must shift from the toothless part 35A in order to meshingly engage with the teeth (i.e. toothed part 35B) of the input-side intermediate gear 35 (see FIG. 5C).

Figure 8:
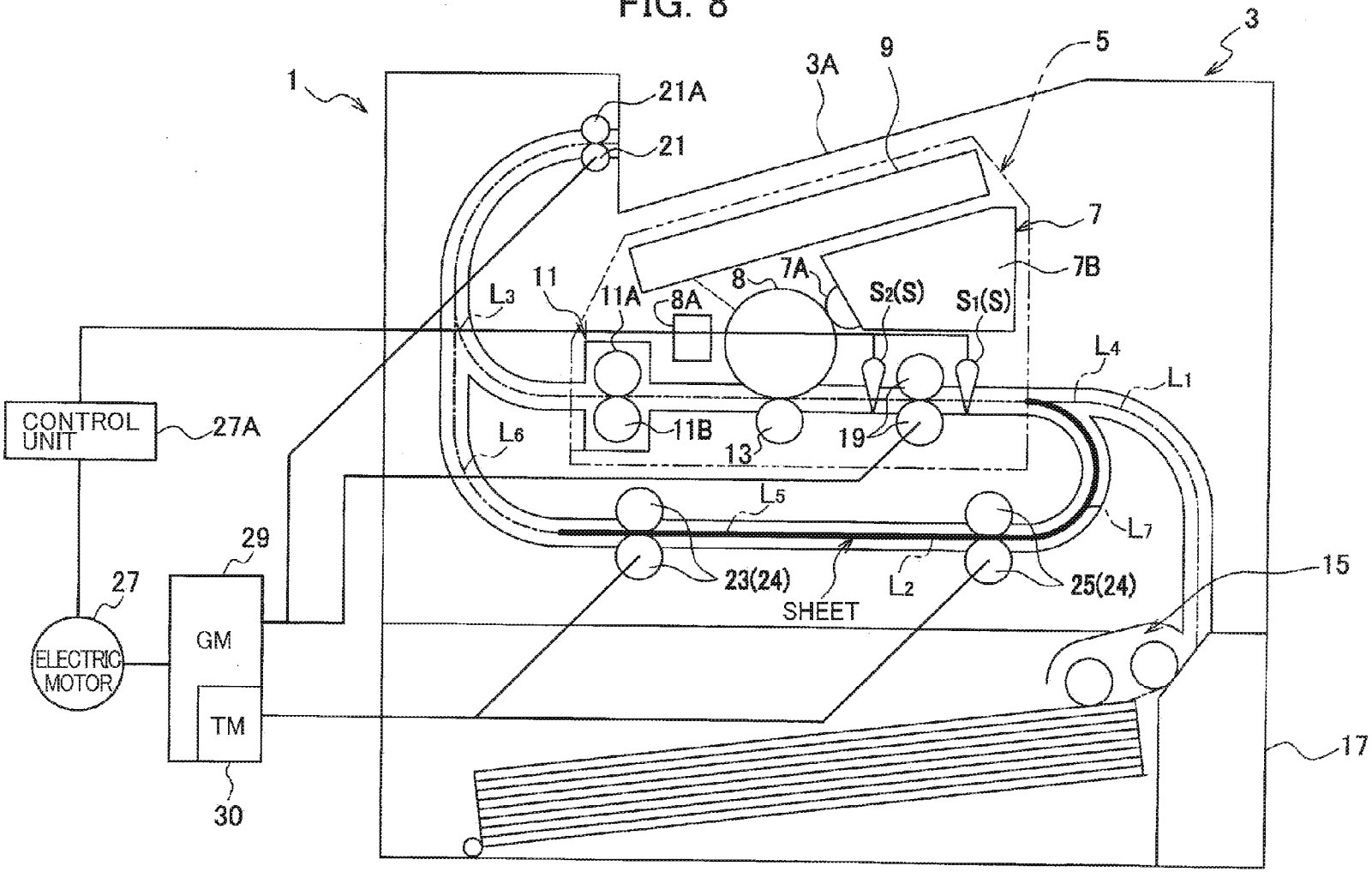
FIG. 8 is a schematic central cross-sectional view of the image forming apparatus 1, illustrating a sheet conveying state following the state shown in FIG. 7.

After being rotated in the reverse direction for a prescribed time, the electric motor 27 is shifted to normal rotation (see FIG. 6). The timing at which the electric motor 27 is shifted from reverse rotation to normal rotation occurs before the leading edge of the sheet relative to the sheet-conveying direction arrives at the pair of registration rollers 19, as illustrated in FIG. 8.

When the electric motor 27 shifts from reverse rotation to normal rotation, the sun gear 32 reverses from counterclockwise to clockwise in rotation in FIG. 4A. Consequently, the first planetary gear 36A is shifted to the third position, and the second planetary gear 36B is shifted to the second position so as to meshingly engage with the toothed part 35B of the input-side intermediate gear 35 (see FIG. 5C).

Since the rotational force of the sun gear 32 is transmitted to the input-side intermediate gear 35 via the second planetary gear 36B, the input-side intermediate gear 35 begins to rotate, rotating the output gear 33 through the output-side intermediate gear 34.

When the input-side intermediate gear 35 has rotated one complete turn (approximately 360 degrees), the toothless part 35A returns to its position confronting the second planetary gear 36B (see FIG. 3C), and the revolving member 37A returns to its engaging position (see FIG. 3A).

At this time, the leading edge of the sheet relative to the conveying direction passes through the pair of registration rollers 19 and begins receiving a conveying force from the image-forming mechanism 5, as shown in FIG. 9. The rotational force from the electric motor 27 is not supplied to the pair of second reconveying rollers 25 at this time. Further, the interrupting unit 31 interrupts transmission of the rotational force from the reconveying rollers 24 to the electric motor 27. The pair of second reconveying rollers 25 rotates while following the movement of the sheet (indicated by a dashed line in a region B of FIG. 6).

3. Features of the Image-Forming Device According to the Embodiment

In the embodiment described above, the image forming apparatus 1 can prevent the reconveying rollers 24 from rotating when a sheet is being conveyed through the image-forming mechanism 5, i.e., when the image forming apparatus 1 is performing simplex printing or is forming an image on the first side of a sheet in duplex printing. Therefore, the structure of the image forming apparatus 1 can reduce noise generated by the rotating reconveying rollers 24.

Further, when a sheet is being conveyed through the image-forming mechanism 5, the image forming apparatus 1 interrupts transmission of a rotational force to the reconveying rollers 24 while the interrupting unit 31 interrupts transmission of a rotational force from the reconveying rollers 24 to the electric motor 27.

Accordingly, a sheet that is being reconveyed receives a conveying force from the image-forming mechanism 5, and the reconveying rollers 24 rotate to follow the conveyed movement of the sheet. Thus, the sheet can be suitably reconveyed despite transmission of the rotational force to the reconveying rollers 24 being interrupted.

<Variations of the Embodiment>

In the embodiment described above, the planetary gears 36 are configured of the first planetary gear 36A and the second planetary gear 36B. However, a structure that includes a single planetary gear 36 may be available. In this case, the single planetary gear 36 is configured to revolve in an area opposite the output gear 33 with respect to the sun gear 32.

In the embodiment described above, the interrupting unit 31 is disposed between the output-side intermediate gear 34 and the input-side intermediate gear 35 on the transmission path of the rotational force. However, for example, the interrupting unit 31 may be provided on the transmission path of the rotational force at a position closer to the reconveying rollers 24 than the output gear 33 to the reconveying rollers 24.

Further, the specific structures of the locking mechanism 37 and the interrupting unit 31 are not limited to those given in the embodiment described above. Other structures may be available for the locking mechanism 37 and the interrupting unit 31.

While the description has been made in detail with reference to the embodiment thereof, it would be apparent to those skilled in the art that many modifications and variations may be made therein without departing from the spirit of the disclosure.

What is claimed is:

1. An image forming apparatus configured to form images on both sides of a sheet, the image forming apparatus comprising:

an image-forming mechanism configured to form an image on a sheet while conveying the sheet;

a discharge tray configured to receive a sheet on which an image is formed;

a switchback roller configured to rotate in one of a normal rotation mode and a reverse rotation mode, the switchback roller in the normal rotation mode conveying a sheet discharged from the image-forming mechanism toward the discharge tray, the switchback roller in the reverse rotation mode conveying the sheet conveyed toward the discharge tray back toward the image-forming mechanism;

a reconveying roller configured to rotate while contacting a sheet to be conveyed back toward the image-forming mechanism to reconvey the sheet toward the image-forming mechanism;

an electric motor configured to supply the image-forming mechanism, the switchback roller, and the reconveying roller with a rotational force for conveying a sheet; and a transmission mechanism configured to operate in one of a reverse-rotation transmission mode and a normal-rotation transmission mode, the transmission mechanism in the reverse-rotation transmission mode reversing a direction of the rotational force received from the electric motor to transmit the reversed rotational force to the reconveying roller, the transmission mechanism in the normal-rotation transmission mode transmitting the rotational force received from the electric motor to the reconveying roller without reversing the direction of the rotational force received from the electric motor, the transmission mechanism including:

an interrupting unit configured to interrupt transmission of a rotational force from the reconveying roller to the electric motor at least when a sheet is being conveyed in the image-forming mechanism, the transmission mechanism being configured to interrupt transmission of the rotational force received from the electric motor to the reconveying roller when a sheet is being conveyed in the image-forming mechanism;

a sun gear configured to rotate upon receipt of the rotational force from the electric motor, the sun gear having a fixed rotational center about which the sun gear rotates;

an output gear configured to output the rotational force received from the electric motor toward the reconveying roller;

a first intermediate gear meshingly engaging with the output gear;

a second intermediate gear coupled to the first intermediate gear via the interrupting unit, the second intermediate gear having a toothless part constituting a part of a circumferential surface of the second intermediate gear in which no teeth are provided; and a planetary gear meshingly engaging with the sun gear and rotating upon rotation of the sun gear, the sun gear being configured to apply a revolving force to the planetary gear for displacing a rotational center of the planetary gear to revolve the planetary gear about the rotational center of the sun gear, the planetary gear being configured to be displaced upon receipt of the revolving force between a first position and a second position, the planetary gear in the first position engaging with the output gear, the planetary gear in the second position being engageable with the second intermediate gear.

2. The image forming apparatus according to claim 1, wherein the image-forming mechanism includes:

a photosensitive drum configured to carry a developer image to be transferred onto a sheet; and a pair of registration rollers configured to correct an orientation of a sheet to be conveyed toward the photosensitive drum, and wherein the interrupting unit is configured to interrupt transmission of the rotational force from the reconveying roller to the electric motor when the pair of registration rollers is in contact with a single sheet while the reconveying roller is in contact with the single sheet.

3. The image forming apparatus according to claim 1, further comprising:

a locking mechanism configured to halt rotation of the second intermediate gear and to situate the planetary gear in the second position at a position within the toothless part when a sheet is being conveyed in the image-forming mechanism, wherein the second intermediate gear has an engagement part, and wherein the locking mechanism includes:

a revolving member having an engaging part engageable with the engagement part, the revolving member being configured to be displaced upon receipt of the revolving force between an engaging position in which the engaging part is in engagement with the engagement part and a release position in which the engaging part is out of engagement with the engagement part; and a spring configured to exert a resilient force on the second intermediate gear to rotate the second intermediate gear to a position where the planetary gear in the second position meshingly engages with the second intermediate gear.

4. The image forming apparatus according to claim 1, wherein the planetary gear comprises a first planetary gear and a second planetary gear, wherein the first planetary gear is configured to be displaced upon receipt of the revolving force between the first position and a third position offset from the first position and different from the second position, and wherein the second planetary gear is configured to be displaced upon receipt of the revolving force between the second position and a fourth position offset from the second position and different from the first position.

5. A transmission mechanism comprising:

a sun gear configured to receive a rotational force and configured to rotate about a rotational axis in a first rotational direction and in a second rotational direction opposite to the first rotational direction;

an output gear configured to output a rotational force;

a first intermediate gear meshing with the output gear;

a second intermediate gear, being a sector gear, including:

a toothed part in which teeth are formed;

a toothless part in which no teeth are formed; and an engagement part;

an interrupting unit configured to be coupled to the first intermediate gear and the second intermediate gear, the interrupting unit being configured to transmit a rotational force from the second intermediate gear to the first intermediate gear and configured to interrupt a rotational force from the first intermediate gear to the second intermediate gear; and a locking mechanism comprising:

a revolving member having an engaging part engageable with the engagement part of the second intermediate gear, the revolving member being configured to move between an engaging position where the engaging part is engageable with the engagement part of the second intermediate gear and a release position where the engaging part is separated from the engagement part of the second intermediate gear, the revolving member moving to the engaging position in response to rotation of the sun gear in the first rotational direction and moving to the release position in response to the rotation of the sun gear in the second rotational direction;

a first planetary gear meshing with the sun gear and supported at the revolving member, the first planetary gear being configured to revolve about the rotational axis of the sun gear along with the revolving member, the first planetary gear being configured to mesh with the output gear in response to the rotation of the sun gear in the second rotational direction;

a second planetary gear meshing with the sun gear and supported at the revolving member, the second planetary gear being configured to revolve about the rotational axis of the sun gear along with the revolving member, the second planetary gear being configured to move to a position capable of meshing with the toothed part of the second intermediate gear in response to the rotation of the sun gear in the first rotational direction; and a spring configured to apply a force to the second intermediate gear to rotate the second intermediate gear in the first rotational direction, wherein:

while the sun gear rotates in the first rotational direction and the second planetary gear faces the toothless part of the second intermediate gear, the revolving member is in the engaging position, and a rotational force of the sun gear rotating in the first rotational direction is transmitted to the second planetary gear facing the toothless part of the second intermediate gear;

when the sun gear changes a rotational direction from the first rotational direction to the second rotational direction, the first planetary gear and the second planetary gear revolve in the second rotational direction about the rotational axis of the sun gear to move the revolving member from the engaging position to the release position, and the spring rotates the second intermediate gear to a position where the toothed part of the second intermediate gear is capable of meshing with the second planetary gear when the revolving member is returned from the release position to the engaging position;

while the revolving member is in the release position, the first planetary gear meshes with the output gear, and a rotational force of the sun gear rotating in the second rotational direction is transmitted to the output gear through the first planetary gear;

when the sun gear changes the rotational direction from the second rotational direction to the first rotational direction, the first planetary gear and the second planetary gear revolve in the first rotational direction about the rotational axis of the sun gear to move the revolving member from the release position to the engaging position, and the second planetary gear meshes with the toothed part of the second intermediate gear to rotate the second intermediate gear until the toothless part of the second intermediate gear faces the second planetary gear, and a rotational force of the sun gear rotating in the first rotational direction is transmitted to the output gear through the second planetary gear, the toothed part of the second intermediate gear, the interrupting unit, and the first intermediate gear while the second planetary gear meshes with the toothed part of the second intermediate gear; and when the toothless part of the second intermediate gear has returned to a position facing the second planetary gear as a result of the rotation of the second intermediate gear through meshing with the second planetary gear while the sun gear rotates in the first rotational direction, transmission of the rotational force of the sun gear rotating in the first rotational direction to the output gear is interrupted.

6. An image forming apparatus configured to form images on both sides of a sheet, the image forming apparatus comprising:

an image-forming mechanism configured to form an image on a sheet while conveying the sheet;

a discharge tray configured to receive a sheet on which an image is formed;

a switchback roller configured to rotate in one of a normal rotation mode and a reverse rotation mode, the switchback roller in the normal rotation mode conveying a sheet discharged from the image-forming mechanism toward the discharge tray, the switchback roller in the reverse rotation mode conveying the sheet conveyed toward the discharge tray back toward the image-forming mechanism;

a reconveying roller configured to rotate while contacting a sheet to be conveyed back toward the image-forming mechanism to reconvey the sheet toward the image-forming mechanism;

an electric motor configured to supply the image-forming mechanism, the switchback roller, and the reconveying roller with a rotational force for conveying a sheet; and a transmission mechanism configured to operate in one of a reverse-rotation transmission mode and a normal-rotation transmission mode, the transmission mechanism in the reverse-rotation transmission mode reversing a direction of the rotational force received from the electric motor to transmit the reversed rotational force to the reconveying roller, the transmission mechanism in the normal-rotation transmission mode transmitting the rotational force received from the electric motor to the reconveying roller without reversing the direction of the rotational force received from the electric motor, the transmission mechanism including:

an interrupting unit configured to interrupt transmission of a rotational force from the reconveying roller to the electric motor at least when a sheet is being conveyed in the image-forming mechanism, the transmission mechanism being configured to interrupt transmission of the rotational force received from the electric motor to the reconveying roller when a sheet is being conveyed in the image-forming mechanism;

a sun gear configured to rotate upon receipt of the rotational force from the electric motor, the sun gear having a fixed rotational center about which the sun gear rotates;

an output gear configured to output the rotational force received from the electric motor toward the reconveying roller;

a first intermediate gear meshingly engaging with the output gear;

a second intermediate gear coupled to the first intermediate gear via the interrupting unit, the second intermediate gear having a toothless part constituting a part of a circumferential surface of the second intermediate gear in which no teeth are provided;

a planetary gear meshingly engaging with the sun gear and rotating upon rotation of the sun gear, the sun gear being configured to apply a revolving force to the planetary gear for displacing a rotational center of the planetary gear to revolve the planetary gear about the rotational center of the sun gear, the planetary gear being configured to be displaced upon receipt of the revolving force between a first position and a second position, the planetary gear in the first position engaging with the output gear, the planetary gear in the second position being engageable with the second intermediate gear; and a locking mechanism configured to halt rotation of the second intermediate gear and to situate the planetary gear in the second position at a position within the toothless part when a sheet is being conveyed in the image-forming mechanism.

7. The image forming apparatus according to claim 6, wherein the image-forming mechanism includes:

a photosensitive drum configured to carry a developer image to be transferred onto a sheet; and a pair of registration rollers configured to correct an orientation of a sheet to be conveyed toward the photosensitive drum, and wherein the interrupting unit is configured to interrupt transmission of the rotational force from the reconveying roller to the electric motor when the pair of registration rollers is in contact with a single sheet while the reconveying roller is in contact with the single sheet.

8. The image forming apparatus according to claim 6, wherein the second intermediate gear has an engagement part, and wherein the locking mechanism includes:

a revolving member having an engaging part engageable with the engagement part, the revolving member being configured to be displaced upon receipt of the revolving force between an engaging position in which the engaging part is in engagement with the engagement part and a release position in which the engaging part is out of engagement with the engagement part; and a spring configured to exert a resilient force on the second intermediate gear to rotate the second intermediate gear to a position where the planetary gear in the second position meshingly engages with the second intermediate gear.

9. The image forming apparatus according to claim 6, wherein the planetary gear comprises a first planetary gear and a second planetary gear, wherein the first planetary gear is configured to be displaced upon receipt of the revolving force between the first position and a third position offset from the first position and different from the second position, and wherein the second planetary gear is configured to be displaced upon receipt of the revolving force between the second position and a fourth position offset from the second position and different from the first position.

* * * * *